US005749033A

United States Patent [19]

Swartz et al.

[11] Patent Number: 5,749,033

[45] Date of Patent: May 5, 1998

[54] DURABLE COATED MAGNETIC DEVELOPMENT ROLLER

[76] Inventors: Edwin Swartz, 2300 Lakeland Dr.; Gene Thomas, 2506 Chadwick Cir., both of Sanford, N.C. 27331

[21] Appl. No.: 580,639

[22] Filed: Dec. 29, 1995

[51] Int. Cl.[6] ..... G03G 15/09

[52] U.S. Cl. ..... 399/267

[58] Field of Search ..... 399/265, 267, 399/276, 279, 282; 492/53, 54

[56] References Cited

U.S. PATENT DOCUMENTS 5,498,837 3/1996 Yamashita ..... 399/276

5,697,029 12/1997 Saitoh et al. ..... 399/279 X

*Primary Examiner*—S. Lee

*Attorney, Agent, or Firm*—William L. London

[57] ABSTRACT

A cylindrical sleeve suitable for holding and conveying image forming toner particles is provided by a hollow cylinder of a non-magnetic material the exterior surface of which is texture by sand blasting and then by electrolessly coating the hollow cylinder with a durable uniform thin layer of an alloy of molybdenum, nickel and phosphorus. The interior of the hollow cylinder contains a magnet capable of generating a magnetic field sufficient to hold toner particles on the surface of the cylindrical sleeve.

9 Claims, 4 Drawing Sheets

DURABLE COATED MAGNETIC DEVELOPMENT ROLLER

BACKGROUND OF INVENTION

1. Field of Invention

This invention relates to an improved durable magnetic developing roller used in imaging forming devices such as laser printers, photo copiers or facsimile machines.

2. Prior Art

Imaging forming devices such as photo copiers, laser printers or facsimile machines make use of the same basic technology. These devices use a substance known as toner to print images on paper or other media. Toner is in effect the ink of this process. Toner is a fine dry powder that flows like a liquid and is typically contained in the toner hopper which in turn is part of the toner cartridge. The toner cartridge also contains the magnetic development roller, doctor blade, the photo conductor and other components.

Toner is both magnetically and electrically attractable. The magnetic developer roller is used to convey and evenly distribute electrically charged toner from the toner hopper to the photo conductive drum. A photo conductive drum is a cylinder coated with material such as selenium or certain organic compounds which will not hold a charge in areas exposed to light. The photo conductive drum is charged either positively or negatively depending on this system. It is exposed to light. The differentially ionized surface of the photo conductive drum differentially attracts the toner. The toner attracted to the drum is then transferred from the photo conductive drum to the paper or other media on which the image is to be printed. The toner is fused to the paper, forming a permanent print of the image.

Magnetic developer rollers must have certain characteristics in order to be successful. First, the surface of the magnetic development roller should be electrically conductive, but not magnetic so as not to interfere with the magnetic field of the internal magnets or any magnetic field generated on the surface of the roller. Second, the surface should have a rough texture so as to better convey and hold toner. Third, the surface must be lubricous so as to readily allow the transfer from the magnetic development roller to the photo conductive drum. Defects in these characteristics can lead to defects in the print quality, including streaking, spotting and poor definition of the print as well as other present defects. These problems are particularly exacerbated after use abrades or corrodes the surface of the magnetic developer roller.

The typical magnetic developer roller is a hollow cylindrical sleeve of some non-magnetic material surrounding a permanent magnet. The sleeve may be made of brass, plastic or stainless steel but it is typically made of aluminum. The sleeve is roughened by sandblasting or other mechanical abrasion in order to improve conveyance of the toner. Sandblasting is the simplest method of roughing this sleeve. Because sandblasting may result in work hardening and embrittlement of materials such as stainless steel, aluminum is the preferred material for this tube.

The aluminum tube, by itself, however, presents some problems. Aluminum readily oxidizes. Furthermore, aluminum is not very wear resistant. For these reasons, manufacturers have coated these aluminum sleeves with other materials to protect the aluminum. The coatings typically used by the original equipment manufacturers are usually not very durable. In part, this lack of durability is because the toner, magnetic development roller, and certain other components are placed by manufacturers in a toner cartridge. The end user replaces the entire cartridge, including the magnetic roller, when the toner in the toner cartridge is exhausted. Since at least the early 1980s, an industry has arisen around recycling toner cartridges. Recycling offers cost savings and substantial environmental advantages by reducing landfill waste associated with disposing of old cartridges and energy cost associated with making all new components. The original equipment manufacturer's magnetic rollers are revised by recyclers. These rollers fail after only a few revisions. A more durable magnetic development roller which could be used repeatedly in recycled toner cartridges is of considerable importance. A durable surface coating which can optimize performance is one way to achieve this goal.

One such coating material for a magnetic development roller is described in U.S. Pat. No. 4,331,101, Müller, et al. Müller describes a magnetic development roller with non-magnetic sleeve of a material such as aluminum, brass or zinc with a coating of a ferro-magnetic material such as nickel in thicknesses of between 0.1 and 1 millimeter. The problem with the coating as in Müller is that the magnetic fields within this coating may interfere with the field generated by the permanent magnets and thus interfere with toner conveyance. Furthermore, the surface coatings described in Müller are unduly thick, therefore more expensive. The thick material coats the manufactured surface reducing toner transfer. The material is also insufficiently hard and durable, and is magnetic. Any magnetism on the surface can interfere with toner transfer.

Another such attempt is described in U.S. Pat. No. 4,368,971, Watanabe, et al. While Watanabe describes the need to maintain the surface roughness on the magnetic development roller, and the need for the surface to be hard and durable. Watanabe also described how if the surface roughness decreases, then toner conveyance also decreases. Watanabe attempts to solve this problem by eliminating the surface roughening step, and by placing grains of hard material such as silicone carbide aluminum oxide in a nickel liquid which is plated on to the magnetic development roller. According to the teachings of Watanabe, these grains provide sufficient roughness to carry toner from the roller to the developer. Watanabe teaches that this type of surface will improve the hardness of a conventional nickel, copper or silver plating liquid.

The problem with a coating described in Watanabe is that these grains may not be electrically conductive, or may conduct electricity at different rates, and therefore may interfere with the magnetic fields generated on the surface of the magnetic development roller. Furthermore, the surface boundaries between the grains and the plating liquid provide sheer planes allowing the grains to abrade away from the surface liquid. Finally, and perhaps most significantly, according to Watanabe requires frequent changing of the plating liquids during plating because grain deposition in such suspensions vary greatly over time, which add to the time and expense of the process.

U.S. Pat. No. 4,526,130, Fukuda, et al describes some of the problems with Watanabe's solution. According to Fukuda, an anodic oxidation coating film such as aluminite or those described in Watanabe may be used over the aluminum sleeve of a magnetic development roller. However, this material has insulating properties that may produce poor copying results. Fukuda proposes an electroless nickel phosphorus alloy coating the aluminum sleeve in which the nickel phosphorus is heat-treated to achieve a hardness in excess of 900 on the Vickers scale. The thickness of this nickel phosphorus coating in Fukuda is considerably less than that described in Muller with a thickness of approximately 5 microns.

The nickel phosphorus alloy is deposited via an electroless nickel chemical plating process. Electroless nickel plating of nickel phosphorus alloys over aluminum was well-known in the art. Nickel phosphorus is more amorphous than pure nickel and therefore more durable. Heat treating of nickel phosphorus was known to increase its hardness.

In thin coatings such as that described in Fukuda, nickel phosphorus, particularly heat treated nickel phosphorus when applied to a magnetic developer roller presents some problems. Heat treating nickel phosphorus alloy increases the magnetism of this alloy in lower phosphorus alloys. Heat treating itself presents difficulties for certain types of magnetic developer rollers during a remanufacture process. Some of these rollers come from the original equipment manufacturer with plastic parts. A remanufacturer of such rollers must remove these parts before heat treating become feasible. Perhaps most important, nickel phosphorus as a coating material in these thin layers has a microscopic grain structure that lends itself to stress cracking, abrasion, and corrosion. The grain size of an electroless nickel phosphorus alloy as described in Fukuda vary significantly. The smaller grains present a larger surface area to volume ratio and are more readily corroded and abraded. This corrosion and abrasion leads to variations in the surface of the magnetic developer roller which in turn leads to deterioration in print quality. In extreme cases, parts of the aluminum substrate may be revealed and oxidized. The present invention is for an improved durable magnetic developer roller with a nickel phosphorus molybdenum coating, which is more durable, lubricous and provides uniform high quality prints after repeated uses.

SUMMARY OF THE INVENTION

The present invention is related to a magnetic development roller for use in an imaging forming device. This roller may be used as original equipment, or this same process may be used to recondition the original equipment manufacturer magnetic development roller. The magnetic development roller of the present invention is durable, corrosion resistant and produces a reliable, good quality print even after repeated use.

The present invention comprises a magnetic development roller for use in an image forming device with a cylindrical sleeve made of a non-magnetic electrically conductive material, preferably aluminum. This sleeve has the surface abraded preferably by sandblasting. The abraded surface is then covered with a wear resistant lubricous electrically conductive surface coating made from an alloy of nickel, phosphorus and molybdenum with a thickness between 1 and 20 microns, which is electrolessly deposited. Interior to this non-magnetic electrically conductive cylinder is a means for generating a magnetic field with sufficient strength to attract toner to the surface of the magnetic development roller but not so strong as to prevent the toner from transferring to the photo conductive drum. In the preferred embodiment, this magnetic field generator is a permanent magnet. The nickel phosphorus molybdenum alloy which forms the surface coating in this application provides a surface with a uniform grain structure which is highly resistant to corrosion, and which is extremely lubricous and non-magnetic. These qualities allow for even transfer of toner from the toner hopper or other reservoir of toner to the photo conductive drum. These qualities also enhance the durability of this magnetic development roller.

DESCRIPTION

The magnetic roller of the present invention is an improved magnetic development roller whose surface characteristics allow for an enhanced transfer of toner from the magnetic development roller to the photo conductive drum, and whose surface characteristics provide for a more durable and lasting device. Magnetic development rollers of this invention have a thin surface coating of an alloy of nickel phosphorus and molybdenum.

Figure 1:
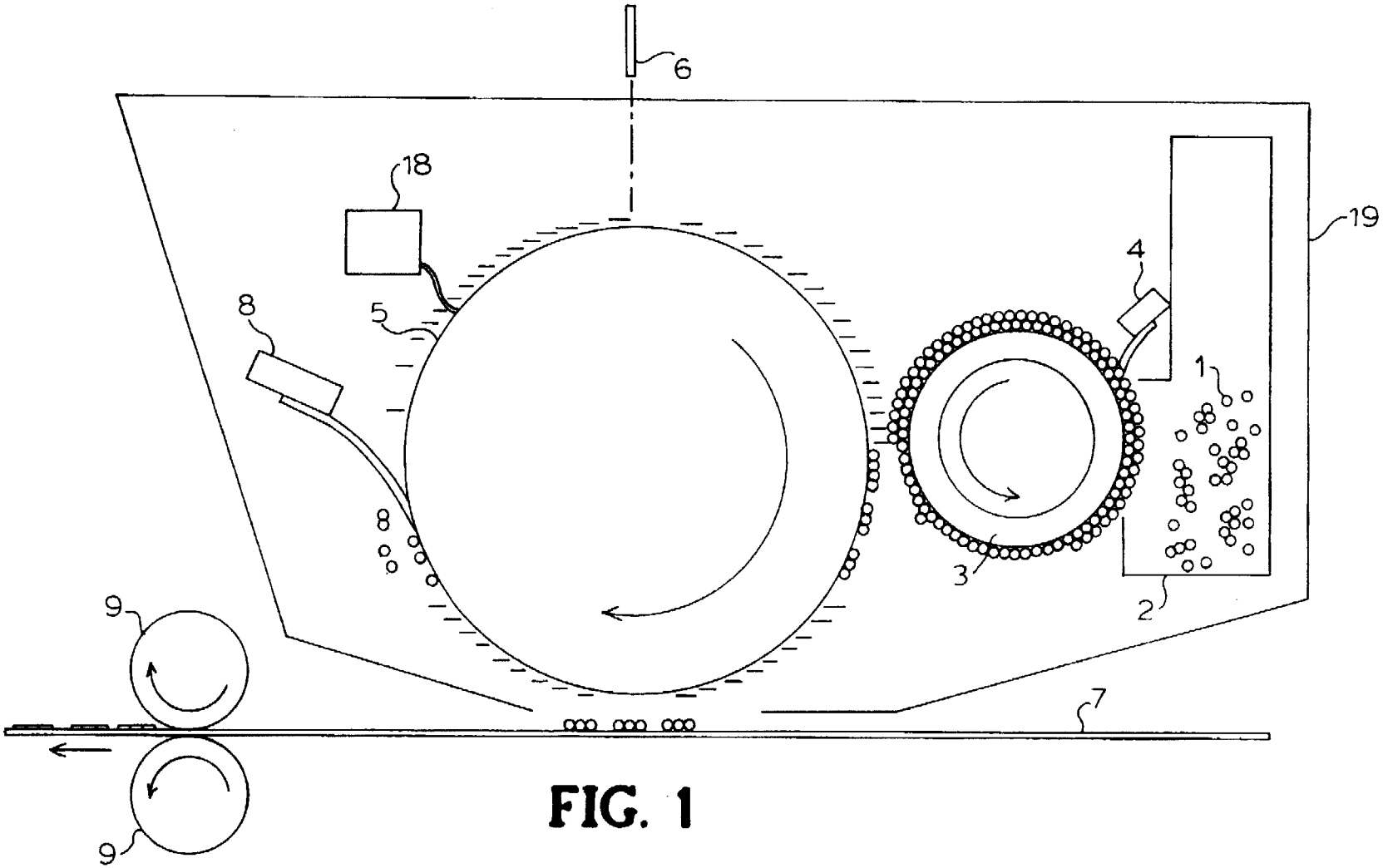
FIG. 1 is a schematic demonstrating the relationship between the magnetic development roller, the toner, and the photo conductive drum in an imaging forming device.

FIG. 1 is a schematic of an image forming device. Toner 1 is contained in a bin known as the toner hopper 2. The magnetic roller 3 rotates and attracts toner particles. A doctor blade 4 removes excessive toner from the magnetic development roller 3 as the magnetic development roller 3 rotates. The photo conductive drum 5 is a charged cylinder coated with a material such as selenium or certain organic components which will not hold a charge in areas exposed to light. The photo conductive drum is charged by a material device, typically something called a primary charging roller 18 which may impart either a positive or negative charge. As image carrying light 6 strikes the cylinder portions of the cylinder become electrically positive in relation to other portions. As these portions of the cylinder rotate adjacent to the magnetic roller, toner 1 leaves the magnetic development roller 3 when attracted to the differently ionized areas of the photo conductive drum 5. Toner 1 on the surface of photo conductive drum 5 is then transferred to the paper or other print media 7. A drum cleaning blade 8 removes any non-transferred toner from the photo conductive drum. The paper or other print media 7 travels past the photo conductive drum through fuser rollers 9 which heat the toner 1 and fuse the toner 1 to the paper or other print media 7.

The magnetic development roller 3, the doctor blade 4, the toner 1, the toner hopper 2, the photo conductive drum 6 and the drum cleaning blade 8 are all typically contained in a single replaceable unit known as the toner cartridge 19. When the toner in the toner hopper 2 is exhausted, the toner cartridge 19 is removed and replaced. The end user may replace the toner cartridge 19 with either a new toner cartridge 19 or a remanufactured toner cartridge 19. There is a substantial difference in price between the two. Remanufactured toner cartridges 19 are as little as one-half the cost of a new toner cartridge 19. If a more durable reliable magnetic development roller 3 is part of either the original equipment or a remanufacturing process then it could be used over and over again, further reducing the cost of recycling toner cartridges. Such a cost reduction would encourage recycling, and provide added environmental benefits by reducing landfill waste.

Figure 2A:
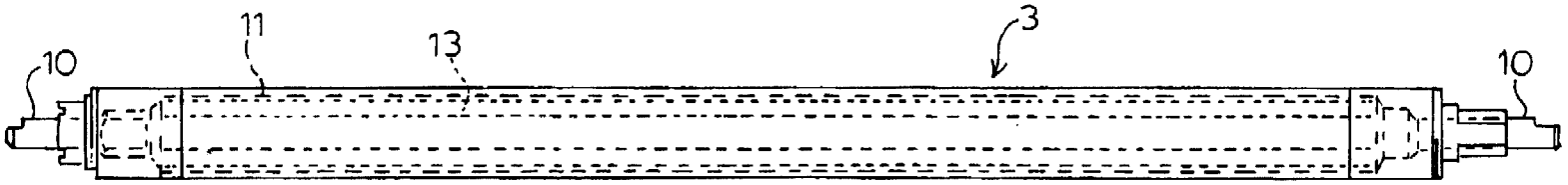
FIG. 2A is a side view of a typical magnetic development roller.
Figure 2B:
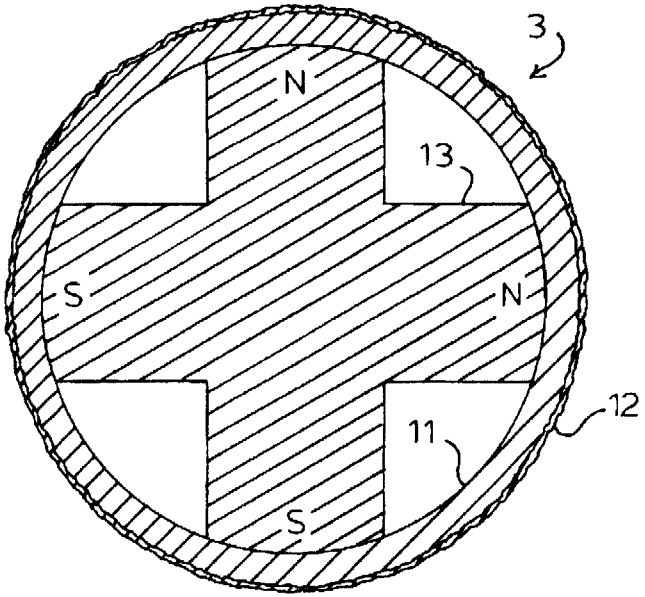
FIG. 2B is a cross-section through the diameter of a typical magnetic development roller.

FIG. 2 shows a magnetic development roller 3 in side view and in cross-section. The magnetic development roller 3 is supported within the toner cartridge 19 on journals 10. These journals 10 act as an axis for the magnetic development roller 3 which is rotated by a variety of means. The journals 10 are attached to a hollow sleeve 11 of some rigid material. This sleeve 11 is typically aluminum although it can be made of a plastic, brass or other non-magnetic rigid material. Inside the sleeve is a magnet 13. It is this magnet occasionally supplemented by electric magnetic forces caused by charges passing through the outer surface 12 of the magnetic development roller 3 which attracts toner particles to the outer surface of the magnetic development roller 3.

The outer surface 12 of the magnetic development roller 3, is that portion of the magnetic development roller which interacts with the toner and other parts of the image forming device. This outer surface 12 of the magnetic development roller 3 must have characteristics which facilitate the smooth and even transfer of toner 1 from the toner hopper 2 to the photo conductive drum 5.

An optimum surface of the magnetic development roller 3 adheres well to the substrate so as not to abrade away. The optimum surface is corrosion resistant, again to protect the substrate. The optimum surface is uniform so as to facilitate a uniform transfer of toner 1 from the toner hopper 2 to the photo conductor drum 5. The optimum surface is extremely lubricous, again to facilitate the transfer of toner 1. Finally, an optimum surface material is one which bonds well with aluminum since aluminum is the most commonly used material by original equipment manufacturers. These qualities together make for a durable magnetic development roller.

The present inventors have conducted extensive research to determine the best material which is practical for these purposes. Electroless nickel plating of nickel phosphorus alloy over aluminum is well known in the art. Beginning in the 1940s and 1950s, such plating has been used to impart a durable surface over aluminum. It was known in the art that nickel phosphorus alloy's hardness, lubricity and magnetism depend upon the percentage of nickel and phosphorus in the alloy, and the post-depositional treatment of the material. Generally, maximum hardness is achieved with the phosphorus content of approximately 5% and the nickel content of approximately 95%. A phosphorus content of 10–15% phosphorus and 85–90% nickel shows increased lubricity. Nickel phosphorus alloys with a phosphorus content above 8% generally cannot be magnetized at room temperatures although they may become magnetic if heat treated. Nickel phosphorus alloys with phosphorus contents above 11% are no longer ferro-magnetic at all, even when heat treated. Heat treating generally improves the hardness of nickel phosphorus alloys.

With these principals in mind, the inventors experimented with a variety of surface coatings to obtain a durable reliable surface coating which would produce good quality prints or copies even after multiple recyclings. To this end the inventors, over the last four to five years, began experimenting with a variety of organic coating materials. Those experiments were unsatisfactory. The inventors next began to experiment with a variety of alloyed materials. Simple nickel phosphorus alloys are fairly common. The inventors experimented by adding other constituents to a basic nickel phosphorus alloy. The inventors approached a variety of manufacturers who make plating compounds. The inventors solicited these manufacturers to provide them with electroless nickel phosphorus materials which included additives of cobalt, tungsten, PTFE, molybdenum, silica carbide. In the course of these experiments, the inventors discovered the practical difficulty of working with PTFE and silica carbide grains in suspension with nickel phosphorus alloy. Plating baths were required to be changed repeatedly.

The inventor experimented with electroless deposits of nickel phosphorus cobalt alloys, nickel phosphorus tungsten alloys. After years of repeated experimentation and testing, the inventor determined that the optimum material for a surface coating of a magnetic development roller is an alloy of nickel, phosphorus and molybdenum. This material offers greater lubricity than a high phosphorus nickel alloy, and perhaps most importantly, provides superior protection against corrosion and wear not offered by any other surface treatment. This material also provides a more uniformly thick surface deposit on the magnetic roller 3. Furthermore, the nickel phosphorus molybdenum alloy is not magnetic. Testing has revealed that the surface coating of this invention provides more uniform copies than any other material tested, or on the market.

After repeated experimentation, the inventors discovered that a nickel phosphorus molybdenum alloy with the molybdenum content of the alloy varying between 0.1% and 5% by mass weight, and of the phosphorus content varying from between 8–12% by mass weight and the nickel content of the alloy forming the remainder of the alloy, provided the optimal characteristics for a magnetic development roller. Such a roller was extremely lubricous providing an efficient use of toner, was hard and corrosion resistant. These characteristics allowed magnetic development rollers treat-coated with this material to be reused repeatedly and still provide clean sharp pages of print for the end user.

A magnetic development roller 3 according to this invention begins with a hollow sleeve preferably made of aluminum. This sleeve may be manufactured, or obtained from a recycled toner cartridge by removing a journal 10 and the means for generating a magnetic field. The surface of this sleeve is then abraded mechanically, preferably by sandblasting. The surface of the sleeve is then prepared for an electroless deposition process as is well known in the industry and described in ASTM Designation B656-91 and many other publications including the Metals Handbook 9th Edition, American Society for Metals. The surface is then electrolessly coated with a nickel phosphorus molybdenum alloy with the percentages described above whose thickness is at least 1 micron and no more than 20 microns. The optional coating is approximately 5 microns. A source of this alloy is Fidelity Chemical Products Corporation, process 5010.

The sleeve should be placed in the electroless solution for between 4.7 minutes and 95 minutes in order to allow for the proper coating. The greater the bath time the greater the thickness. The plating solution should be changed after no more than 8 plating cycles. Journals 10 may be left in place during coating of recycled magnetic development rollers. These journals may either be recycled journals or newly manufactured parts.

Figure 3A:
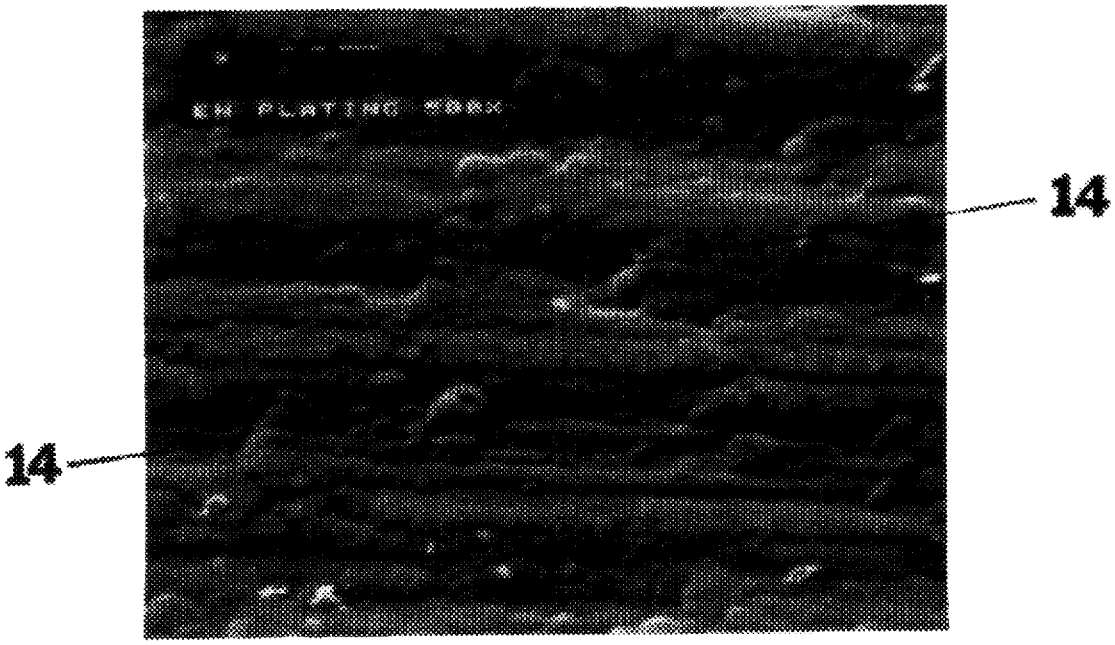
FIG. 3A is a scanning electron microscope image of the surface of a magnetic development roller with a surface coating using standard electrolessly nickel plated nickel phosphorus alloy magnified 500 times.

FIG. 3A is a scanning electron microscope image of a standard nickel phosphorus alloy coating a magnetic development roller. The pores 14 represent discontinuities either in the grain size of the metal crystals, or discontinuities in the plating process itself.

Figure 3B:
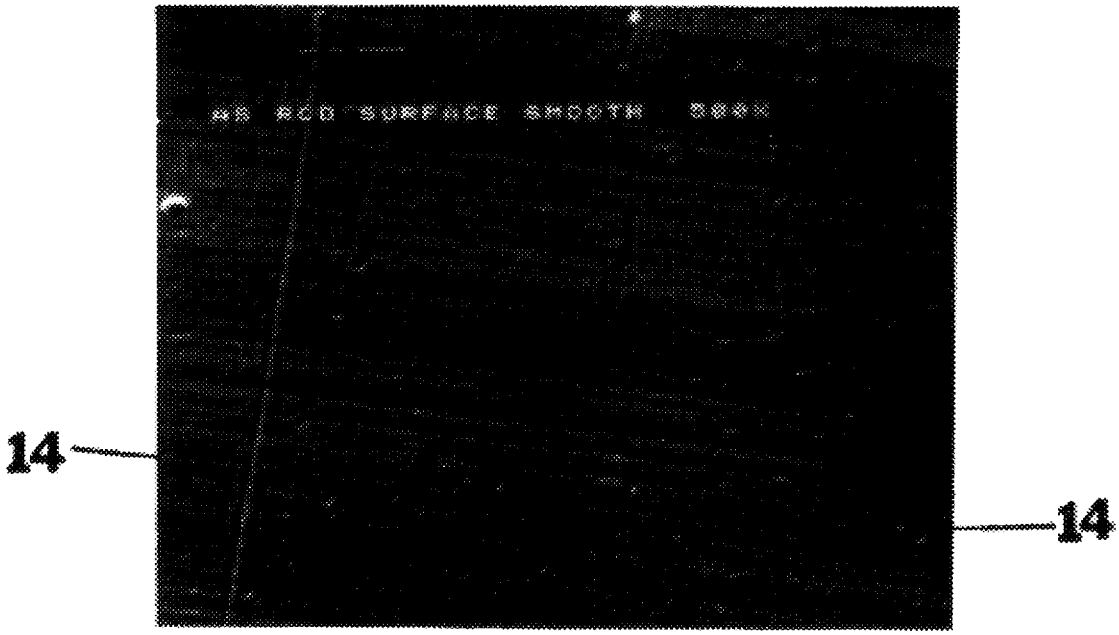
FIG. 3B is a scanning electron microscope image of the surface of a magnetic development roller coated with a nickel phosphorus molybdenum alloy magnified 500 times.

FIG. 3B is a scanning electron microscope image of the surface of a magnetic development roller coated with the nickel phosphorus molybdenum alloy of this invention. As can be readily seen in FIG. 3B the pores 14 of the nickel phosphorus molybdenum alloy in this application are fewer, smaller, and more disbursed than that of a high phosphorus nickel phosphorus alloy alone. The fewer, more scattered pores are less likely to allow corrosion of the substrate, and provide a uniform, lubricous surface to transfer the toner from, confirming the results of the inventor's performance tests.

Figure 4:
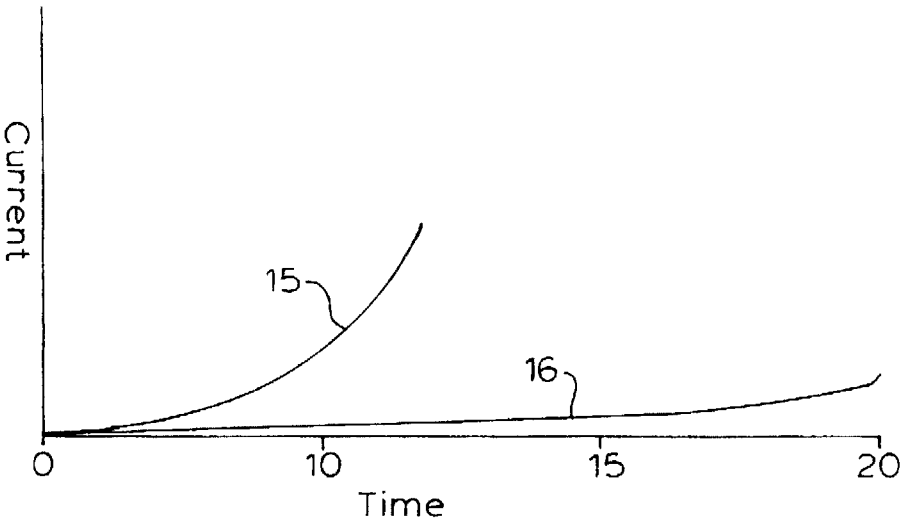
FIG. 4 is a graphic representation of current flow overtime of a standard high phosphorus nickel phosphorus alloy coating over aluminum vs. the nickel phosphorus molybdenum alloy over aluminum used in this invention.

FIG. 4 shows two curves plotted on a graph which opposes current vs. time. The first curve, 15 shows a standard high phosphorus nickel phosphorus alloy deposited over aluminum. The second curve 16 shows the nickel phosphorus molybdenum alloy of this invention over aluminum. These curves plot the flow of current over time from the material to a standard solution, in this case a silver/silver chloride solution. The lower current flow of the alloy of this invention illustrates the increased resistance of this alloy to corrosion in this process.

Figure 5:
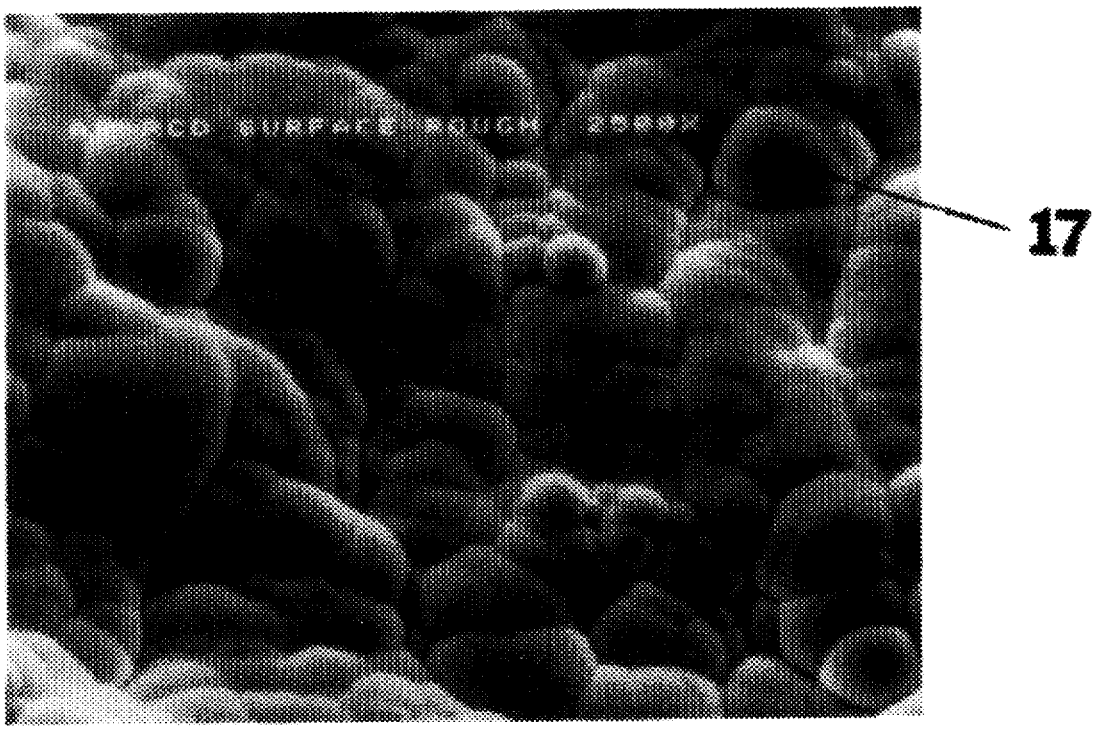
FIG. 5 is a scanning electron microscope image of the nickel phosphorus molybdenum alloy surface coating over an aluminum sleeved magnetic development roller magnified 2,500 times.

FIGS. 5 is another illustration of the reason for the increased resistance of this invention to corrosion. FIG. 5 is a scanning electron microscope image of the magnetic development roller of this invention showing the surface characteristics of the nickel phosphorus molybdenum alloy in this application. The grain 17 represent the crystalline structure on the surface of the material of the metallic alloy. These grains are large and uniform in size. Such grains are more durable, less readily corroded, and more difficult to abrade than ordinary surface treatments such as coating with a simple nickel phosphorus alloy, of aluminum magnetic rollers. These other surface treatments have a greater variability in the size of the metal grain, more discontinuities between a surface coating and a differential abrasive material such as luminite, or metaloxide. The information revealed by the scanning electron microscopic images shown in FIGS. 3A and B, and FIG. 5, as well as the data revealed on the graph in FIG. 4 confirm the inventor's experimentation. The nickel phosphorus molybdenum alloy surface coating in this application provides a less corrosive, more uniform and more durable surface for a magnetic development roller which in turn allows this magnetic development roller to be reused and recycled while still providing good crisp copies.

We claim:

1. A magnetic roller for use in a printing or copying apparatus comprising;

a) A cylindrical sleeve made of a non-magnetic electrically conducted material with a textured exterior surface;

b) A wear resistant lubricious electrically conducted surface coating adhered to the textured exterior surface of the cylindrical sleeve, said surface coating being formed from an alloy of nickel, phosphorus and molybdenum;

c) Means for generating a magnetic field sufficient to attract toner to the surface coating, said means for generating a magnetic field disposed within the cylindrical sleeve.

2. A magnetic roller as in claim 1 wherein the exterior surface of the cylindrical sleeve is textured by sand blasting.

3. A magnetic roller as in claim 1 wherein the surface coating alloy is deposited on the roller in an electroless deposition process.

4. A magnetic roller as in claim 1 when the molybdenum content of the surface coating alloy is between 0.05% and 5% by atomic weight.

5. A magnetic roller as claim 1, wherein the surface coating alloy has a uniform microscopic grain structure.

6. The magnetic roller as in claim 1 wherein the cylindrical sleeve is comprised of aluminum.

7. The magnetic roller as in claim 1 wherein the surface of the cylindrical sleeve is textured by mechanical abrasion.

8. The magnetic roller as in claim 1 wherein the surface coating has a thickness of between 1 and 20 microns.

9. The magnetic roller as in claim 1 wherein the cylindrical sleeve is comprised of an aluminum alloy.

* * * * *